United States Patent [19]

Artzt et al.

[11] Patent Number: 4,697,411

[45] Date of Patent: Oct. 6, 1987

[54] OPEN-END SPINNING DEVICE

[75] Inventors: Peter Artzt; Hans Rottmayr; Wolfgang Bauer, all of Reutlingen, Fed. Rep. of Germany

[73] Assignee: Schubert & Salzer, Ingolstadt, Fed. Rep. of Germany

[21] Appl. No.: 878,973

[22] PCT Filed: Nov. 11, 1985

[86] PCT No.: PCT/DE85/00446

§ 371 Date: Jun. 30, 1986

§ 102(e) Date: Jun. 30, 1986

[87] PCT Pub. No.: WO86/02954

PCT Pub. Date: May 22, 1986

[30] Foreign Application Priority Data

Nov. 13, 1984 [DE] Fed. Rep. of Germany ..... 3441492

[51] Int. Cl.[4] ..... D01H 7/892; D01H 7/882; D01H 1/135

[52] U.S. Cl. ..... 57/401; 57/408

[58] Field of Search ..... 57/400, 401, 408–413, 57/90

[56] References Cited

U.S. PATENT DOCUMENTS 3,132,465 5/1964 Putnam ..... 57/401
3,636,693 1/1972 Benson et al. .
4,168,601 9/1979 Didek et al. .
4,348,859 9/1982 Olsson ..... 57/401
4,522,023 1/1985 Stahlecker ..... 57/401
4,545,194 10/1985 Juillard ..... 57/400
4,557,105 12/1985 Brockmanns et al. ..... 57/401
4,573,312 3/1986 Brockmanns et al. ..... 57/401 X

FOREIGN PATENT DOCUMENTS 377017 1/1985 Austria .

*Primary Examiner*—Donald Watkins
*Attorney, Agent, or Firm*—Dority & Manning

[57] ABSTRACT

The invention concerns and open-end spinning device having two friction rollers driven in the same direction and forming a spinning notch, whereby at least the friction roller rotating towards the spinning notch is made as a suction roller, conveying the fiber material fed onto its casing surface into the spinning notch. According to invention, a collecting groove for the arriving fiber material is provided at a distance from the spinning notch, said groove being constituted by the casing surface of the friction roller rotating towards the spinning notch and by a moving guiding surface. According to the invention the surface speed of the guiding surface in the collecting groove is synchronized with the surface speed of the friction roller.

24 Claims, 4 Drawing Figures

OPEN-END SPINNING DEVICE

BACKGROUND AND SUMMARY OF THE INVENTION

The invention concerns an open-end spinning device with two friction rollers driven in the same direction and forming a spinning notch, in which at least the friction roller rotating towards the spinning notch is a suction roller for, feeding the fiber material brought onto its casing surface into the spinning notch where the fibers are twisted together into a thread.

Prior art discloses a device in which the fibers are pulled from an unravelling device, are blowin by an air stream onto the casing of a suction roller and are fed by said suction roller into the spinning notch formed by the suction roller and by another roller with a closed casing surface, driven in the same direction of rotation as the suction roller (DE-OS No. 1,902,111=U.S. Pat. No. 3,636,963). The fibers are twisted by friction into a yarn in the spinning notch, said yarn being drawn off continuously. However, the quality of the yarn produced on this device is unsatisfactory, especially at high spinning speeds.

In another known open-end friction spinning device the unravelled fibers are fed onto the casing surface of the suction roller by means of a feeding channel, the outlet of which lies in the peripheral sense of the suction roller, facing the casing surface of the suction roller, separated by a space from the wedge-shaped slot or spinning notch (DE-OS No. 3 300 636). The edge of the feeding channel outlet is designed as a deflection guide which is to accelerate and stretch the fibers as they emerge from the feeding channel. This device however, did not yield the expected results.

It is the objective of the present invention to create a device which makes it possible to produce yarn of greater uniformity and better suitability for high-speed production.

This objective is attained by the invention with a device as described in the introductory clause of claim 1 by providing, separated by a space from the spinning notch, a collecting groove for the arriving fiber material, said collecting groove being formed by the casing surface of the friction roller rotating towards the spinning notch and by a moving guiding surface having a surface speed, in the collecting groove, that is synchronized with the surface speed of the friction roller.

By depositing the fibers in a collecting groove formed by two moving surfaces, an exact and defined collection and gathering of the fiber material is achieved. The fed fibers are pre-doubled and are conveyed to the spinning notch in a very uniform formation. This influences the quality of the yarn favorably.

The collecting groove is formed in a simple manner by a roller in close proximity of the friction roller. A variant of the device provides for the guiding surface, at the bottom of the collecting groove, to be supported on the surface of the friction roller. In order to give the fibers additional guidance as they emerge from the collecting groove, the guiding surface follows the surface of the friction roller into the spinning notch. This is achieved by constituting the guiding surface as the surface of an endelss band. The guiding surface is suitably pressed against the casing surface of the friction roller. In another advantageous variant, the moving guiding surface is follwed by a fixed guiding surface.

The fixed guiding surface, in this instance, extends suitably into the spinning gusset.

By providing for a space between the fixed guiding surface and the moving guiding surface, an air current is created in direction of the friction roller, holding the fibers on the friction roller. This air current can be reinforced by providing the fixed guiding surface with perforations leading to the atmosphere. In order to prevent the fibers from builidng up or frombeing brushed off the friction roller as they pass from the moving to the fixed guiding surface, the edge of the fixed guiding surface facing the moving guiding surface is rounded off.

Trouble-free conveying of the fibers to the spinning notch is ensured by providing a space between the fixed guiding surface and the friction roller. Preferably, the fibers are fed into the collecting groove in the longitudinal sense of said groove, so that they are parallel to the yarn axis as they reach the spinning notch and are joined to the rotating yarn end. Uniformity and strength of the yarn are thereby further enhanced.

To ensure the depositing of fibers on the friction roller as soon as they are fed into the collecting groove and to ensure their being held in the spinning notch, the friction roller is provided with a negative pressure zone beginning before the collecting grove and extending, in the sense of rotation, into the spinning notch. Defined conditions for holding the fibers during their being conveyed as well as in the spinning notch are created by subdividing the negative pressure zone of the friction roller into at least two segments with different suction force, in the peripheral sense of the suction roller.

Favorable spinning conditions are achieved by providing at least one of the friction rollers with a sector of greater negative pressure in the spinning notch, in the area of yarn forming. In practice, the friction roller rotating toward the spinning notch is provided with a sector of greater negative pressure. A width of from 4 to 8 mm for this sector is preferable. A width of 6 mm has proven to be especially favorable. The twist and the solidity of the yarn are even further improved by extending the sector by approximately 1 mm beyond the palne of the friction roller axes onto the side opposite to the spinning notch. Improved results are also obtained when the middle of the sector is located in the friction roller axes plane, in the peripheral sense of the side opposite to the spinning notch.

The fact that a sector of lower negative pressure follows a sector of greater negative pressure on the friction roller rotating towards the spinning notch lowers air consumption without adversely affecting the security of fiber conveying on the friction roller.

BRIEF DESCRIPTION OF THE DRAWINGS

Two examples of embodiments according to the invention are described in the drawing hereinafter.

FIG. 1 shows two friction rollers 1 and 2, both designed as suction rollers. The friction rollers 1 and 2, parallel and in close proximity to each other, constitute a spinning notch 3 in which the arriving fibers are twisted into a yarn. To achieve this, friction rollers 1 and 2 are rotated in the same direction by means not shown in further detail here.

DESCRIPTION OF THE PREFERRED EMBODIMENT

Figure 1:
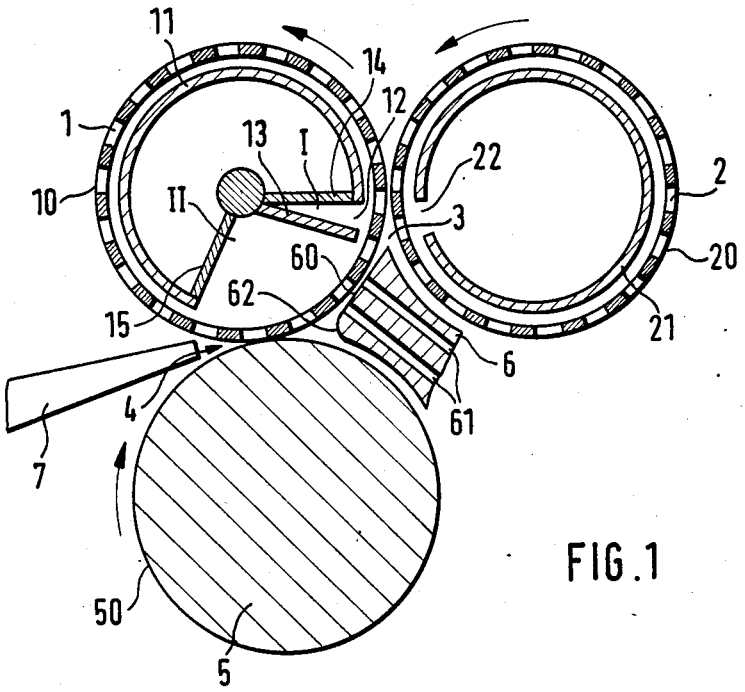
FIG. 1 shows an embodiment of the spinning device according to the invention in cross-section.

Friction rollers 1 and 2 are each equipped with a perforated casing surface 10 and 20 and with suction inserts 11 and 21 which are connected to a suction device (not shown). Suction inserts 11 and 21 are provided with slits 12 and 22 extending in the longitudinal sense of the spinning notch 3, whereby a suction air stream is created through said slits. While friction roller 2, turning away from the spinning notch 3, is provided with only one negative pressure zone determined by slit 22, the negative pressure zone of the friction roller rotating in direction of the spinning notch 3 extends from a restriction wall 15 into the spinning notch 3 and ends there at restriction wall 14. In the sense of rotation, restriction wall 15 is located before a collecting groove 4, further described hereinbelow.

Figure 4:
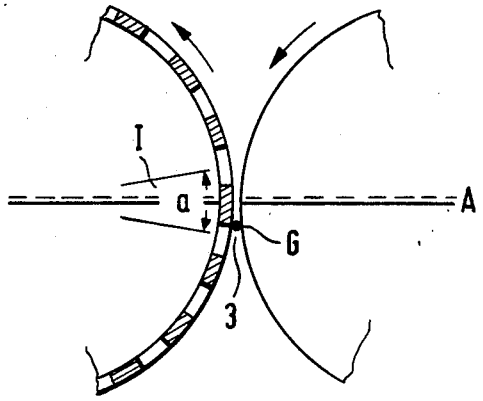
FIG. 4 shows the notch area of two friction rollers in cross-section.

The low-pressure zone of friction roller 1 is subdivided by a separation wall 13 into two sectors I and II with different suction force, whereby sector I forming slit 12, has greater negative pressure in the yarn forming area. The negative pressure in sector II has merely the function of ensuring that the fibers are securely held on friction roller 1 during their travel to the spinning notch 3 and said pressure is consequently weak. The negative pressure in sector I, on the other hand, must be sufficiently strong to ensure proper spinning. Experience has shown here that with appropriately selected negative pressure in the yarn-forming zone G, especially good spinning results are obtained with respect to strength if sector I, forming slit 12, is 4 to 8 mm wide, and preferably 6 mm wide in the peripheral sense, and if it extends by approximately 1 mm beyond the plane A of axis of friction rollers 1 and 2, onto the side opposite to spinning notch 3. In the example of FIG. 1, this applies also to slit 22 of suction roller 2 which faces sector I. Tests have shown that increased yarn strength also results if the middle of sector I lies within the axial plane A (FIG. 4) or is at a distance of approximately 1 mm from axial plane A, in direction of the side opposite to spinning notch 3. This is indicated by the broken line in FIG. 4.

In the sense of rotation of friction roller 1, a movable guiding surface 50 follows a fixed guiding surface 60, said movable guiding surface 50 being formed by the surface, facing friction roller 1, of a housing part 6 located between friction rollers 1 and 2 and roller 5. Guiding surface 60 follows the contour of friction roller 1 at a distance into spinning notch 3 and is furthermore separated from the movable guiding surface 50 by a space. Thus an air stream in direction of friction roller 1 can be created between roller 5 and housing part 6, needed to hold the fibers on friction roller 1 and furthermore preventing roller 5 from carrying off any fibers. Perforations 61 in the fixed guiding surface 60, open to the atmosphere, further reinforce the air stream in direction of friction roller 1.

In order to prevent fibers from accumulating as they leave the moving guiding surface 50, the edge 62 of the fixed guiding surface 60, facing the movable guiding surface 50, is rounded off.

The fiber material to be spun into thread is fed in the form of a fiber band into an unravelling device (not shown) in the classical manner, said unravelling device separating the material into single fibers. The single fibers are fed through a fiber channel 7 (FIG. 2) into collecting groove 4 in which they are collected and arranged into a fiber formation. The fiber formation, held upon the casing surface 10 of friction roller 1 by means of the suction air stream is given greater cohesion and stricter guidance by the moving guiding surface 50 supported on casing 10 as said fiber formation leaves collecting groove 4, and this guidance function is then taken over by the following, fixed guiding surface 60 and is maintained until reaching spinning notch 30. In this manner, a pre-doubled, uniform fiber formation reaches spinning notch 3, thereby improving yarn quality.

Figure 2:
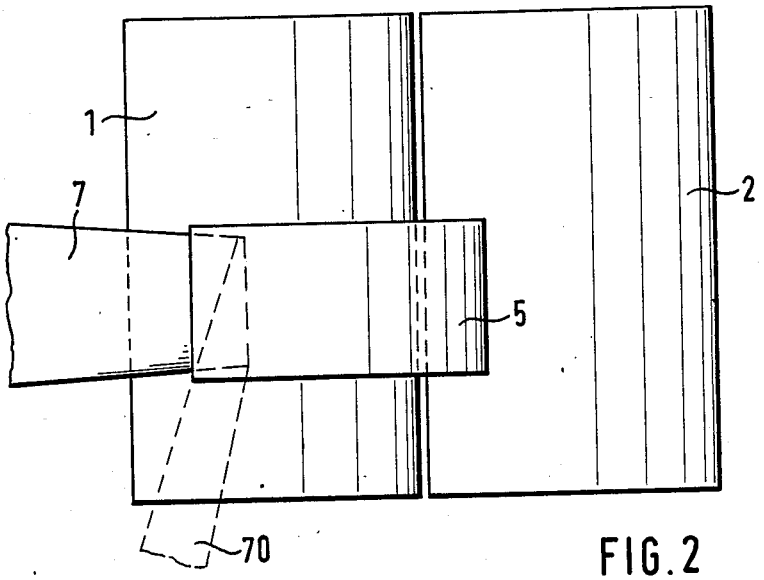
FIG. 2 shows the device of FIG. 1 in horizontal projection.

Further improvement of yarn parameters is achieved if the fibers are fed into the collecting groove 4 in the longitudinal sense of said groove. This type of feeding is indicated in FIG. 2 by a fiber channel 70. The fibers are brought into a position parallel to the yarn axis as they pass through said fiber channel and are conveyed into spinning notch 3. This is extremely favorable for an orderly incorporation of the fibers into the rotating, free yarn end and for their uniform arrangement within the yarn. An angle between longitudinal and transversal direction can of course be provided when appropriate.

Figure 3:
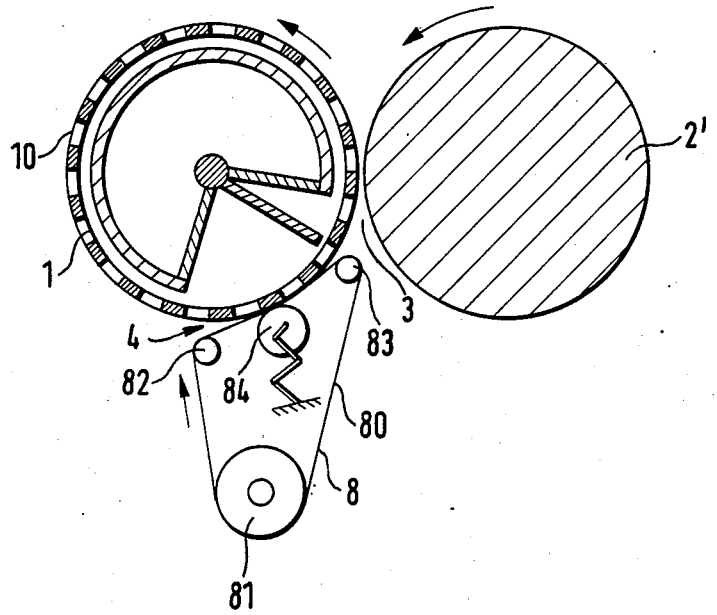
FIG. 3 shows another embodiment of the spinning device according to invention in cross-section.

In the example of FIG. 3 the friction roller of FIG. 1, rotating towards the spinning notch 3 and functioning as a suction roller, is featured again. The second friction roller 2', which together with friction roller 1 forms the spinning notch 3 however, is not perforated and not subjected to suction. Collecting groove 4 is formed by the casing surface 10 of friction roller 1 and by an endless band 8. The surface of the endless band 8 constitutes a moving guiding surface 80 extending into the spinning notch 3.

The endless band 8 is guided over deflection rollers 81, 82 and 83 and is pressed by at least one pressure roller 84 against casing surface 10 of friction roller 1, so that the guiding surface 80 at the bottom of collecting groove 4 is supported on casing surface 10.

The contact pressure of pressure roller 84 is reinforced by a spring so that the endless band 8 is securely driven by friction roller 1, whereby the surface speed of guiding roller 8 in the collecting groove 4 is synchronized with the surface speed of friction roller 1.

The function and the effect of this device are identical to those of the device in FIGS. 1 and 2.

We claim:

1. An open-end spinning device for spinning fibers, comprising two friction rollers driven in the same direction and forming a spinning notch therebetween, whereby at least the friction roller rotating in the direction of the spinning notch is a suction roller and includes a casing having a casing surface for receiving fibers thereon, the suction rollers conveying the fibers received on the casing surface into the spinning notch where the fibers are twisted together into a thread; a moving guiding surface; and a collecting groove for the fibers provided at a distance from the spinning notch, said groove being formed by the casing surface of the friction roller which rotates in direction of the spinning notch and by the moving guiding surface, the surface speed of which, inside the collecting groove, is synchronized with the surface speed of the suction roller.

2. A device as defined in claim 1, further comprising a roller, and wherein the collecting groove is formed by the roller being in close proximity of the friction roller which rotates in the direction of the spinning notch.

3. A device as defined in claim 1, wherein the guiding surface is supported adjacent the casing surface of the friction roller which rotates in the direction of the spinning notch, at the bottom of the collecting groove.

4. A device as defined in claim 1, wherein the guiding surface follows the surface of the friction roller which rotates in the direction of the spinning notch, into the spinning notch.

5. A device as defined in claim 4, further comprising an endless band, wherein the guiding surface includes the surface of the endless band.

6. A device as defined in claim 3, wherein the guiding surface is pressed against the casing surface of the friction roller which rotates in the direction of the spinning notch.

7. A device as defined in claim 1 or 3, further comprising a fixed guiding surface, wherein the moving guiding surface is followed by the fixed guiding surface.

8. A device as defined in claim 7, wherein the fixed guiding surface extends into the spinning notch.

9. A device as defined in claim 7, wherein the fixed guiding surface is separated by a space from the moving guiding surface.

10. A device as defined in claim 7, wherein the fixed guiding surface defines perforations therein open to the atmosphere.

11. A device as defined in claim 7, wherein the fixed guiding surface includes a rounded edge facing the moving guiding surface.

12. A device as defined in claim 7, wherein the fixed guiding surface is separated by a space from the friction roller which rotates in the direction of the spinning notch.

13. A device as defined in claim 1 or 3, wherein the fibers are fed into the collecting groove in the longitudinal sense of said collecting groove.

14. A device as defined in claim 1 or 3, wherein the friction roller which rotates in the direction of the spinning notch is provided with a negative pressure sector which, in the sense of rotation, begins before the collecting groove and extends adjacent the spinning notch.

15. A device as defined in claim 14, wherein the negative pressure zone of the friction roller which rotates in the direction of the spinning notch is subdivided, in the peripheral sense, into at least two sectors of differing suction force.

16. A device as defined in claim 15, further comprising a yarn forming zone between the friction rollers, wherein at least one of the friction rollers is provided with a sector adjacent the spinning notch, within the yarn forming zone, of greater negative pressure than the at least one other sector.

17. A device as defined in claim 16, wherein the friction roller rotating towrads the spinning notch is provided with a sector of increased negative pressure relative to the at least one other sector.

18. A device as defined in claim 16, wherein the second adjacent the spinning notch is from 4 to 8 mm wide.

19. A device as defined in claim 16, wherein one of the sectors is adjacent the spinning notch and is 6 mm wide.

20. A device as defined in claim 16, wherein the sector adjacent the spinning notch lies within a plane including the axes of the friction rollers.

21. A device as defined in claim 19, wherein the middle of the sector adjacent the spinning notch is located, in the peripheral sense, at a distance from a plane including the axes of the friction rollers, on the side of the plane proximate where the fibers enter the spinning notch.

22. A device as defined in claim 16, further comprising a sector of lesser negative pressure following the sector adjacent the spinning notch of the friction roller which rotates towards the spinning notch, in order to convey the fibers into the yarnforming zone.

23. A device as defined in claim 19, wherein the sector adjacent the spinning notch extends by approximately 1 mm beyond a plane including the axes of the friction rollers on the side of the plane proximate where the fibers enter the spinning notch.

24. An open-end spinning device for use with an open-end spinning machine for spinning fibers together into a thread, the open-end spinning device comprising:

two friction rollers for being driven in the same direction, said two friction rollers defining a spinning notch therebetween for receiving and twisting the fibers into thread; at least one of said two friction rollers rotating in a direction for delivering the fibers to said spining notch, said at least one of said two friction rollers having a casing surface through which suction may be applied, said at least one of said two friction rollers being for conveying the fibers received thereby on said casing surface thereof into said spinning notch;

a moving guide surface for moving fibers towards said spinning notch; and a collecting groove spaced from said spinning notch, said collecting groove being defined by said casing surface rotating in said direction for delivering fibers to said spinning notch and by said moving guide surface; said moving guide surface moving in said direction for delivering fibers to said spinning notch at a speed substantially equal to the surface speed of said casing surface.

* * * * *